US010964271B2

(12) United States Patent
Kwon et al.

(10) Patent No.: US 10,964,271 B2
(45) Date of Patent: Mar. 30, 2021

(54) SENSING CIRCUIT OF SOURCE DRIVER AND DISPLAY DEVICE USING THE SAME

(71) Applicant: SILICON WORKS CO., LTD., Daejeon (KR)

(72) Inventors: Yong Jung Kwon, Daejeon (KR); Min Young Jeong, Daejeon (KR); Sang Min Lee, Daejeon (KR); Jeung Hie Choi, Cheongju-si (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/471,538

(22) PCT Filed: Dec. 12, 2017

(86) PCT No.: PCT/KR2017/014541

§ 371 (c)(1),
(2) Date: Jun. 19, 2019

(87) PCT Pub. No.: WO2018/124542

PCT Pub. Date: Jul. 5, 2018

(65) Prior Publication Data

US 2019/0318694 A1 Oct. 17, 2019

(30) Foreign Application Priority Data

Dec. 27, 2016 (KR) ..... 10-2016-0180359

(51) Int. Cl.
*G09G 3/3275* (2016.01)
*G09G 3/3258* (2016.01)

(52) U.S. Cl.
CPC ..... *G09G 3/3275* (2013.01); *G09G 3/3258* (2013.01); *G09G 2300/0842* (2013.01); *G09G 2320/0295* (2013.01)

(58) Field of Classification Search
CPC ... G09G 2300/0842; G09G 2320/0295; G09G 2360/16; G09G 2370/08; G09G 3/3258; G09G 3/3275
See application file for complete search history.

(56) References Cited

U.S. PATENT DOCUMENTS 9,202,411 B2 12/2015 Jung et al.
9,299,315 B2 3/2016 Chen et al.
(Continued)

FOREIGN PATENT DOCUMENTS

KR 100858615 B1 9/2008
KR 100891331 B1 3/2009
KR 20150078358 A 7/2015
KR 20160010163 A 1/2016
(Continued)

OTHER PUBLICATIONS

International Search Report and Written Opinion; PCT No. PCT/KR2017/014541; dated Jun. 11, 2018.
(Continued)

*Primary Examiner* — Chun-Nan Lin
(74) *Attorney, Agent, or Firm* — Polsinelli PC

(57) ABSTRACT

Disclosed are a source driver and a display device using the same, and the display device includes the source driver that generates sensing data by performing a pre-processing operation on pixel data obtained by sensing display pixels, and a timing controller that generates correction data for correction for pixel characteristics by performing a post-processing operation on the sensing data.

20 Claims, 5 Drawing Sheets

(56) References Cited

U.S. PATENT DOCUMENTS

| | | | | |
|---|---|---|---|---|
| 9,514,713 | B2 | 12/2016 | Lee et al. | |
| 2014/0176622 | A1* | 6/2014 | Jung | G09G 3/3208 345/690 |
| 2017/0064227 | A1* | 3/2017 | Lin | H04N 5/367 |
| 2017/0070692 | A1* | 3/2017 | Lin | H04N 5/2176 |
| 2017/0111071 | A1 | 4/2017 | Yoo et al. | |

FOREIGN PATENT DOCUMENTS

| | | | |
|---|---|---|---|
| KR | 20160082852 | A | 7/2016 |
| KR | 20160083154 | A | 7/2016 |
| KR | 20170081048 | A | 7/2017 |
| WO | 2018124542 | A2 | 7/2018 |

OTHER PUBLICATIONS

English abstract of KR20170081048; retrieved from www.espacenet.com on Jun. 18, 2019.
English abstract of KR100891331; retrieved from www.espacenet.com on Jun. 18, 2019.
English abstract of KR20160083154; retrieved from www.espacenet.com on Jun. 18, 2019.
English abstract of KR20160010163; retrieved from www.espacenet.com on Jun. 18, 2019.
English abstract of KR20160082852; retrieved from www.espacenet.com on Jun. 18, 2019.
English abstract of KR20150078358; retrieved from www.espacenet.com on Jun. 18, 2019.
English abstract of KR100858615; retrieved from www.espacenet.com on Jun. 18, 2019.
Translated International Report and Written Opinion for PCT No. PCT/KR2017/014541.
Texas Instruments; "4-Bit Binary Fill Adder With Fast Carry"; Data sheet acquired from Harris Semiconductor, Aug. 1998—Revised May 2000; pp. 1-13.
Texas Instruments; "Dual 4-Line to 1-Line Data Selectors/Multiplexers"; Dec. 1982—Revised Sep. 1987.

* cited by examiner

SENSING CIRCUIT OF SOURCE DRIVER AND DISPLAY DEVICE USING THE SAME

BACKGROUND

1. Technical Field

The present disclosure relates to a sensing circuit of a source driver and a display device using the same, and more particularly, to a sensing circuit of a source driver that senses a pixel signal of a display panel to compensate for the characteristics of pixels of the display panel, and a display device using the same.

2. Related Art

In a display device using an organic light emitting diode (OLED), a pixel display state may be changed corresponding to the same display data according to the characteristics of each pixel using the OLED. A pixel deviation may indicate that the display state corresponding to the same display data changes for each pixel according to the characteristics of each pixel.

For example, the pixel deviation of a display panel may be sensed by a sensing circuit of a source driver, and a timing controller may solve the pixel deviation by correcting display data by using sensing data provided from the source driver.

Recently, high resolution of display panels have been developed.

As described above, when the resolution of the display panels is increased, a time margin for sensing the pixel deviation is reduced, and the amount of sensing data to be transmitted within a limited time from the source driver to the timing controller is increased. Therefore, there is a problem that the source driver needs to transmit a lot of sensing data to the timing controller for a short time in high-resolution display panels.

SUMMARY

Various embodiments are directed to a source driver capable of reducing the amount of sensing data to be transmitted from the source driver to a timing controller to reduce a transmission time of the sensing data, and a display device using the same.

Various embodiments are directed to a source driver that processes pixel data, which corresponds to pixel signals obtained by sensing pixels, together with a timing controller, and a display device using the same.

Various embodiments are directed to a source driver capable of reducing a manufacturing cost and a mass production time of a timing controller by sharing the correction for sensing data with the timing controller, and a display device using the same.

In an embodiment, a sensing circuit of a source driver includes: an operation circuit configured to, by performing an operation on pixel data obtained converted from sensing signals obtained by sensing pixels of a display panel, generate sensing data having a smaller number of bits than the pixel data; and a transmission unit configured to transmit the sensing data to a timing controller.

In an embodiment, a sensing circuit of a source driver includes: a bit selection unit configured to receive a bit selection signal, and, by perform an operation of selecting some pixel data corresponding to the bit selection signal from pixel data obtained converted from sensing signals obtained by sensing pixels of a display panel, generate sensing data having a smaller number of bits than the pixel data; and a transmission unit configured to transmit the sensing data to a timing controller.

In an embodiment, a display device includes: a source driver including a sensing circuit for performing a pre-processing operation on pixel data obtained by converting sensing signals of pixels of a display panel, and configured to generate sensing data having a smaller number of bits than the pixel data by the pre-processing operation of the sensing circuit and provide the sensing data; and a timing controller including a correction circuit for receiving the sensing data and performing a post-processing operation on the sensing data, and configured to generate correction data for correction for characteristics of a pixel by the post-processing operation of the correction circuit.

According to the present disclosure, the amount of sensing data provided from the source driver of the display device to the timing controller is reduced, so that it is possible to reduce the transmission time of the sensing data.

Furthermore, the source driver can partially perform correction for display data, thereby sharing the correction for the display data with the timing controller.

Furthermore, according to the present disclosure, the source driver partially shares the correction for the display data with the timing controller, so that it is possible to reduce a manufacturing cost and a mass production time of the timing controller.

DETAILED DESCRIPTION

Figure 1:
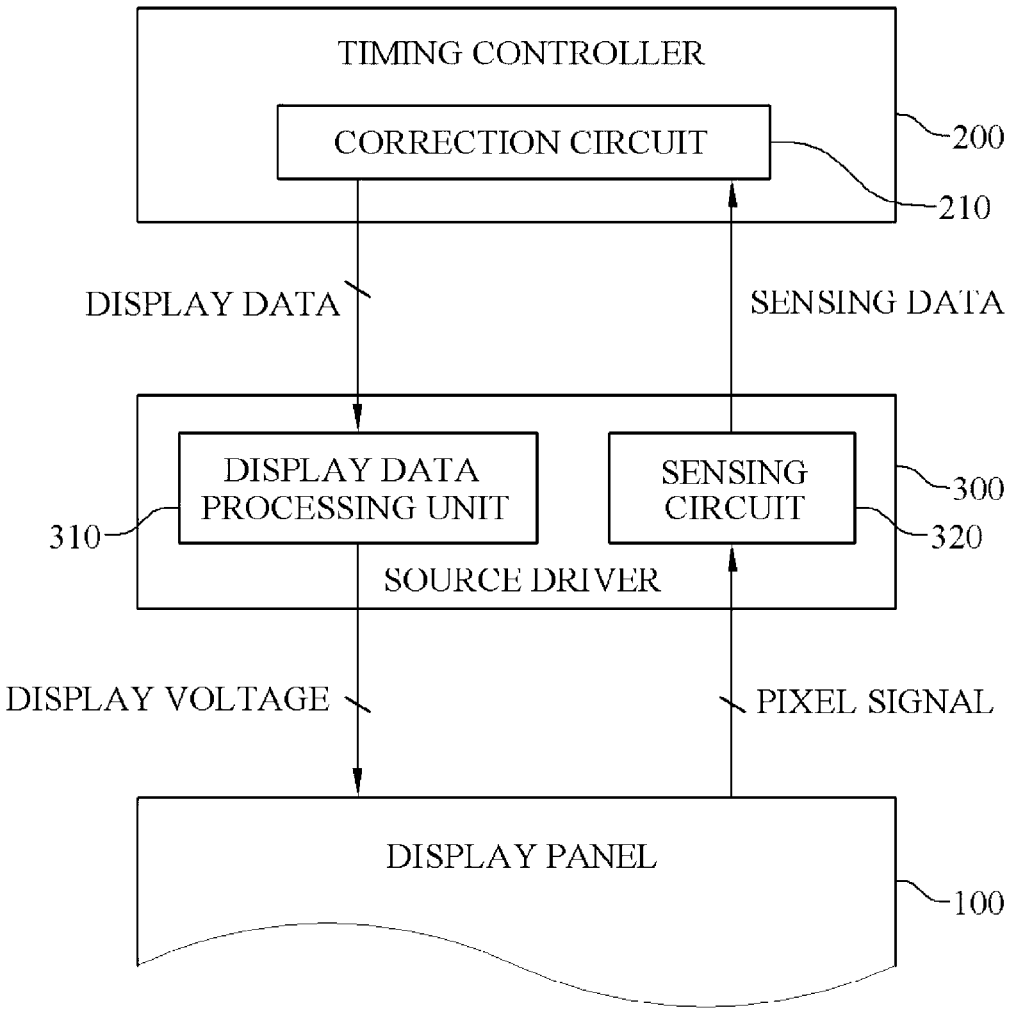
FIG. 1 is a block diagram illustrating an embodiment according to a display device of the present disclosure.

Hereafter, embodiments of the present disclosure will be described in detail with reference to the accompanying drawings. The terms used in this specification and claims are not interpreted as being limited to typical or dictionary meanings, but should be interpreted as meanings and concepts which coincide with the technical idea of the present disclosure.

Embodiments described in this specification and configurations illustrated in the drawings are preferred embodiments of the present disclosure, and do not represent the entire technical idea of the present disclosure. Thus, various equivalents and modifications capable of replacing the embodiments and configurations may be provided at the time of filling the present application.

FIG. 1 is a block diagram illustrating an embodiment of a display device of the present disclosure. Referring to FIG. 1, the display device includes a display panel 100, a timing controller 200, and a source driver 300.

In the display panel 100, a plurality of gate lines (not illustrated) and a plurality of data lines (not illustrated) are formed and pixels are formed at intersection positions of the gate lines and the data lines.

The pixels may be formed in a matrix form. Each pixel may implement a desired color by a combination of red (R), green (G), and blue (B) subpixels and may further include white (W) subpixels for luminance enhancement.

Each subpixel may include an organic light emitting diode (OLED), and may include a driving transistor (not illustrated), a switching transistor (not illustrated), a capacitor (not illustrated) and the like. Hereinafter, in the description of the present disclosure, a pixel may be understood as a subpixel.

A voltage corresponding to display data may be applied to the data lines of the display panel 100, and the OLED of each pixel may operate according to the voltage. Although not illustrated in the drawing, each pixel may be connected to a power supply voltage (VDD) line and a ground voltage (VSS) line.

Furthermore, the pixels of the display panel 100 may be connected to sensing lines (not illustrated) arranged at predetermined intervals. The sensing lines are for providing a pixel signal for sensing the characteristics of the pixels from the pixels of the display panel 100 to the source driver 300.

The characteristics of the pixels may be sensed in various methods and a pixel signal may be outputted through the sensing lines as a sensing result. The pixel signal has information representing a threshold voltage and mobility of the driving transistor of each pixel or deterioration characteristics of the OLED.

The pixel signal may be sensed as a current or a voltage. Furthermore, the pixel signal may be sensed during a power-on time at which the display device is powered on or a driving period for which an image is displayed.

As described above, the pixel signal outputted through the sensing line may be sampled in the source driver 300. In the above description, the period during which the pixel signal is provided to the source driver 300 may be defined as a sensing period. The source driver 300 provides the timing controller 200 with sensing data corresponding to the pixel signal.

The timing controller 200 may provide display data to the source driver 300 and perform compensation corresponding to the characteristics of the pixels by correcting display data and the like for driving the pixels in correspondence to the sensing data.

The display device configured in the embodiment of the present disclosure includes the source driver 300 for performing a pre-processing operation and the timing controller 200 for performing a post-processing operation.

The source driver 300 includes a sensing circuit 320 that performs a pre-processing operation on pixel data obtained by converting sensing signals of the pixels of the display panel, and the sensing circuit 320 generates sensing data having a smaller number of bits than the pixel data by the pre-processing operation and provides the sensing data to the timing controller 200.

The timing controller 200 includes a correction circuit 210 that receives the sensing data of the source driver 300 and performs a post-process operation on the sensing data. The correction circuit 210 generates correction data for correcting the characteristics of the pixels by the post-processing operation.

The timing controller 200 may perform correction corresponding to the pixel characteristics by correcting display data by using the correction data of the correction circuit 210.

The embodiment of the present disclosure is configured such that the source driver 300 and the timing controller 200 share the processing of pixel data corresponding to pixel signals.

Accordingly, in the embodiment of the present disclosure, the source driver 300 shares the correction for the sensing data, so that it is possible to reduce a time required for the correction by the timing controller and a memory required for the correction. Accordingly, in the embodiment of the present disclosure, it is possible to reduce a manufacturing cost and a mass production time of the timing controller 200.

The source driver 300 includes a display data processing unit 310 that applies a display voltage corresponding to the display data to the display panel 100.

The display data processing unit 310 is configured to drive the display voltage corresponding to the display data of the timing controller 200 and to provide each pixel with the display voltage through the data lines of the display panel 100.

The display data processing unit 310 may include a latch, a level shifter, a digital analog converter, a gamma voltage circuit, and an output buffer in order to drive the display data as the display voltage. The latch stores the serially transmitted display data in parallel, the level shifter transmits the display data of the latch to the digital analog converter, the gamma voltage circuit provides gamma voltages corresponding to the display data, the digital analog converter selects a gamma voltage corresponding to the display data provided from the level shifter, and the output buffer drives the gamma voltage selected by the digital analog converter and outputs the driven voltage as the display voltage.

The source driver 300 includes the sensing circuit 320 that senses a pixel signal for each channel of the display panel, converts the sensed pixel signal into pixel data, generates sensing data having a smaller amount than the pixel data by performing a pre-processing operation, and transmits the sensing data to the timing controller 200.

The sensing circuit 320 may be configured as illustrated in FIG. 2 to FIG. 5.

Figure 2:
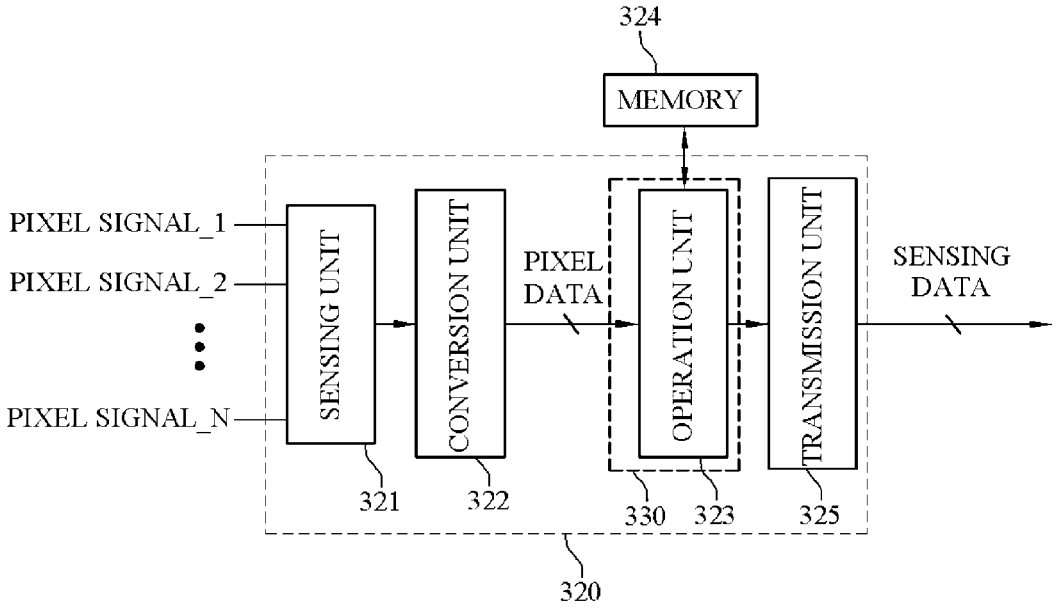
FIG. 2 is a block diagram illustrating an embodiment of a sensing circuit of FIG. 1.

Referring to FIG. 2, the sensing circuit 320 includes a sensing unit 321, a conversion unit 322, an operation circuit 330, and a transmission unit 325. For example, the operation circuit 330 includes an operation unit 323.

The sensing unit 321 may sense a pixel signal_1 to a pixel signal_N of the display panel 100, select the sensed pixel signal_1 to pixel signal_N one by one, and provide the selected pixel signals. To this end, the sensing unit 321 may include a plurality of sample and hold circuits (not illustrated) for sampling each of the pixel signal_1 to the pixel signal_N, and a multiplexer (not illustrated) for selecting the output of the sample and hold circuits one by one and transmitting the selected output to the conversion unit 322.

The conversion unit 322 converts the analog pixel signals transmitted through the sensing unit 321 into digital pixel data. To this end, the conversion unit 322 may be composed of various types of analog digital converters (ADCs).

The operation unit 323 may receive the pixel data corresponding to the pixel signal_1 to the pixel signal_N from the conversion unit 322, and perform a pre-processing operation of generating sensing data by performing an operation on the pixel data. For example, the operation unit 323 may generate the sensing data by a pre-processing operation of obtaining at least one of an average value of the pixel data and a difference between the pixel data. The pre-processing operation is configured to generate sensing data having a smaller number of bits than the pixel data.

More specifically, the operation unit 323 may be composed of a logic circuit that obtains the sum of the pixel data and obtains an average value of the pixel data by dividing the sum by the number of the pixel data. The operation unit 323 may obtain the sensing data having a smaller number of bits than the pixel data while representing the pixel data through the aforementioned operation.

For example, when the operation unit 323 performs an average operation, the summed pixel data may be divided through shifting of bits so that an average value may be computed. Preferably, the number of pixel data provided to the operation unit 323 in order to compute the average value through the shifting is set to $2^M$ (M is a natural number).

Furthermore, the operation unit 323 may be composed of a logic circuit that generates sensing data by sequentially obtaining a difference between two pieces of pixel data. The sensing data may have a smaller number of bits than the pixel data.

The transmission unit 325 may receive the sensing data provided by the operation unit 323 and transmit the received sensing data to the timing controller 200. The transmission unit 325 may be configured to form the sensing data into a packet and transmit the packet to the timing controller 200, or to convert the parallel state into a serial state and transmit the serial sensing data to the timing controller 200

The sensing unit 321 and the conversion unit 322 of the sensing circuit 320 may sense the pixel signals during the sensing period and convert the pixel data, and the operation unit 323 may perform a pre-processing operation on the pixel data of the conversion unit 322 during the sensing period.

Meanwhile, the sensing circuit 320 may further include a memory 324, and the memory 324 may be connected to the operation unit 323, store data required while the operation unit 323 generates the sensing data by processing the pixel data, and provide the operation unit 323 with the data required for the operation.

By the aforementioned pre-processing operation of the operation unit 323, the source driver 300 provides the timing controller 200 with the sensing data having a smaller number of bits than the pixel data. That is, the source driver 300 performs a pre-processing operation of sharing an operation to be performed in order for the timing controller 200 to generate correction data, so that it is possible to reduce the operation burden of the timing controller 200.

Furthermore, the source driver 300 can transmit a smaller amount of sensing data than the pixel data to the timing controller 200, thereby reducing the transmission time of the sensing data.

The timing controller 200 receives the sensing data transmitted from the source driver 300, and generates correction data for correction of the characteristics of the pixels by the correction circuit 210 that performs a post-processing operation. Then, the timing controller 200 may perform compensation corresponding to the pixel characteristics by correcting display data by using the correction data.

As described above, the timing controller 200 may be configured to reduce the design of a logic circuit for a post-processing operation by performing correction for display data by utilizing a small amount of sensing data transmitted from the source driver 300, and to have a memory with a small capacity. Accordingly, it is possible to reduce a manufacturing cost and a mass production time of the timing controller 200.

Figure 3:
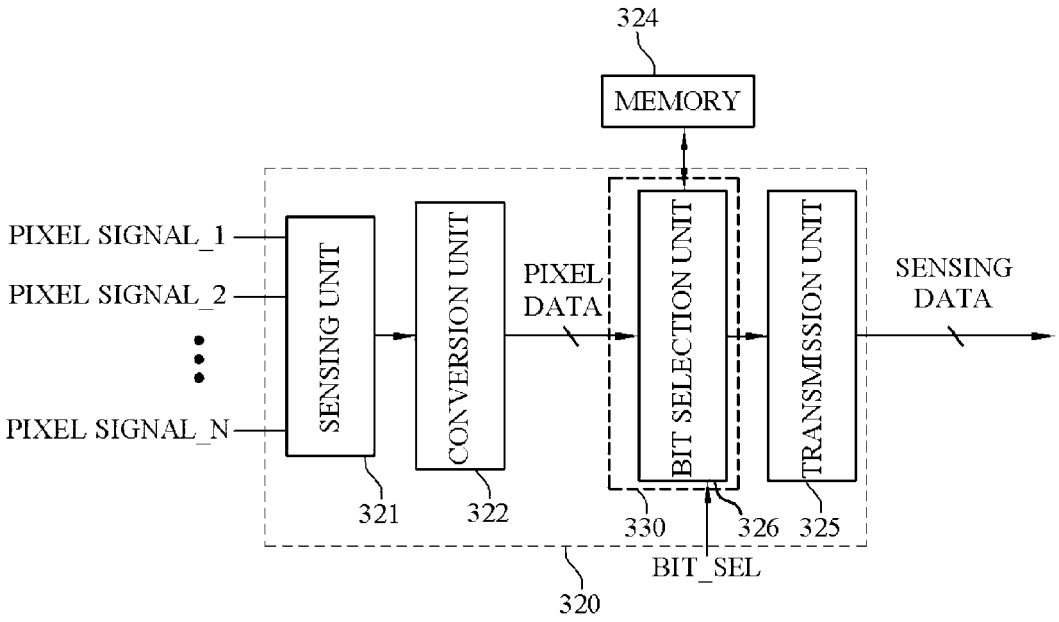
FIG. 3 is a block diagram illustrating another embodiment of the sensing circuit of FIG. 1.

Referring to FIG. 3, the sensing circuit 320 includes the sensing unit 321, the conversion unit 322, the memory 324, the operation circuit 330, and the transmission unit 325.

The elements included in the sensing circuit 320 of FIG. 3, which are the same as those of FIG. 2, will not be described in order to avoid redundancy.

In the sensing circuit 320 of FIG. 3, the operation circuit 330 has a configuration for generating sensing data by performing an operation to select some of pixel data. To this end, the operation circuit 330 may include a bit selection unit 326.

The bit selection unit 326 may receive a bit selection signal BIT_SEL, select some of bits constituting pixel data in correspondence to the bit selection signal BIT_SEL, and generate and output the selected bits as the sensing data.

The bit selection signal BIT_SEL is a signal provided from the outside of the bit selection unit 326, and may be generated and provided by various external circuits in addition to the timing controller 200. The bit selection signal BIT_SEL may include data for specifying a method in which the bit selection unit 326 selects a specific bit from the pixel data.

TABLE 1

| Transmission resolution | Transmission time |
|---|---|
| 4 bits | 76.8 μs |
| 5 bits | 96.0 μs |
| 6 bits | 115.2 μs |
| 7 bits | 134.4 μs |
| 8 bits | 153.6 μs |
| 9 bits | 172.8 μs |
| 10 bits | 192.0 μs |

<Table 1> illustrates the transmission time according to the transmission resolution (or the number of bits) of transmitted sensing data. It can be seen that the smaller the transmission resolution (or the number of bits) of the sensing data, the shorter the transmission time.

The bit selection unit 326 selects some of the bits of the pixel data to generate the sensing data. Therefore, the number of the bits of the sensing data is smaller than that of the pixel data.

Accordingly, as the source driver 300 transmits the sensing data having a smaller number of bits than the pixel data, it is possible to reduce a data transmission amount and a data transmission time by a decrease in the number of bits.

The method in which the bit selection unit 326 selects some of the bits constituting the pixel data in correspondence to the bit selection signal BIT_SEL is as follows.

When a valid value of the pixel data is formed in the lower bits or upper bits within a predetermined range, the bit selection unit 326 may not select at least one upper bit or lower bit, but may select only some lower bits or upper bits of the range in which the valid value is formed.

For example, when the pixel data is composed of 9 bits or more, but the pixel data has only a valid value within the range of 0 to 255, the bit selection unit 326 may select only the lower 8 bits of the bits of the pixel data to generate the sensing data.

In another example, when the pixel data is composed of 10 bits, but the pixel data has only a value within the range of 256 to 511, the bit selection unit 326 may select only the lower 8 bits to generate the sensing data because the upper 2 bits are fixed to '01'.

When precise sensing is not required, the values of the upper bits are more important than those of the lower bits in the correction of the timing controller 200. In such a case, the bit selection unit 326 may select only some upper bits of the pixel data.

TABLE 2

| BIT_SEL | Transmission bit |
|---|---|
| LL | 10 bits |
| LH | 9 bits |
| HL | 8 bits |
| HH | 7 bits |

<Table 2> illustrates the size of bits selected by the bit selection unit 326 according to the configuration of the bit selection signal BIT_SEL. The bit selection unit 326 may select lower bits or upper bits in correspondence to the logic value of the bit selection signal BIT_SEL according to a predetermined manner.

The aforementioned selection of the bits of the pixel data by the bit selection unit 326 may be controlled by the bit selection signal BIT_SEL.

Furthermore, the bit selection unit 326 itself may also adjust the number of bits to be selected by sensing the resolution of received pixel data, regardless of the bit selection signal BIT_SEL. More specifically, the bit selection unit 326 may be configured to check some of the upper bits of the pixel data and select bits corresponding to valid bits of a digital code of the pixel data.

More specifically, when a bit having a digital value of 1 is sensed from the most significant bit, the bit selection unit 326 may select the bit and a lower bit than the bit to generate sensing data. For example, when pixel data composed of 10 bits and having a data value of 255 or less is provided, the most significant bit and the second most significant bit each have a digital value of 0 and the third most significant bit and subsequent bits have a value of 1. Therefore, the bit selection unit 326 may select the third most significant bit to the least significant bit as valid bits to generate sensing data.

Figure 4:
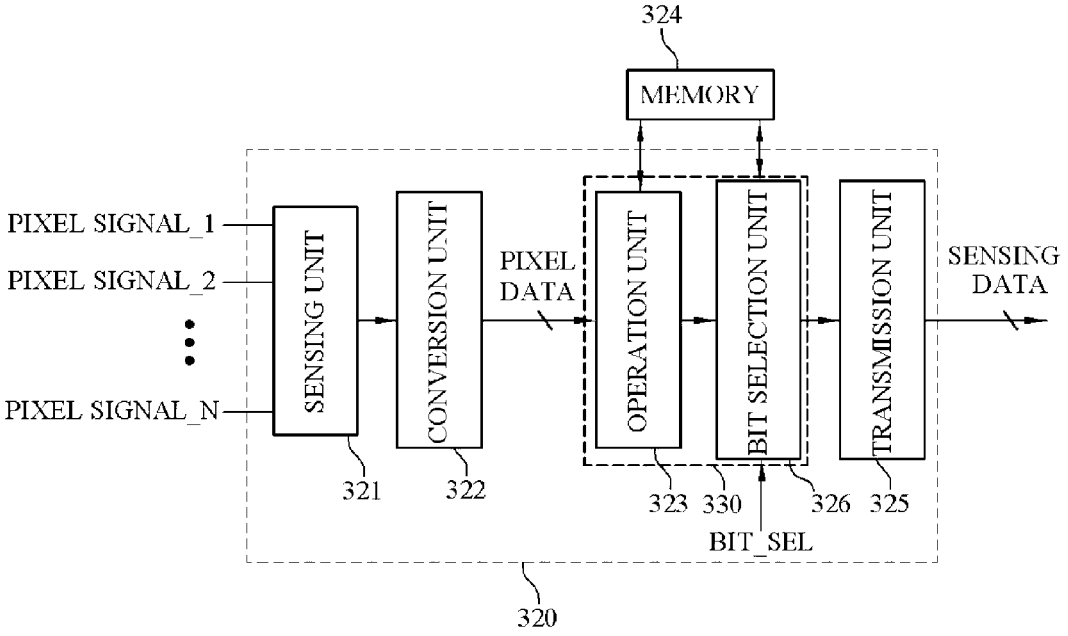
FIG. 4 is a block diagram illustrating still another embodiment of the sensing circuit of FIG. 1.

Referring to FIG. 4, the sensing circuit 320 includes the sensing unit 321, the conversion unit 322, the operation circuit 330, the memory 324, and the transmission unit 325. The operation circuit 330 includes the operation unit 323 and the bit selection unit 326.

In FIG. 4, the operation unit 323 performs a first operation on pixel data obtained by converting sensing signals of the pixels of the display panel, and the bit selection unit 326 generates sensing data by performing a second operation for selecting some of the pixel data subjected to the first operation.

The elements included in the sensing circuit 320 of FIG. 4, which are the same as those of FIG. 2 and FIG. 3, will not be described in order to avoid redundancy.

Figure 5:
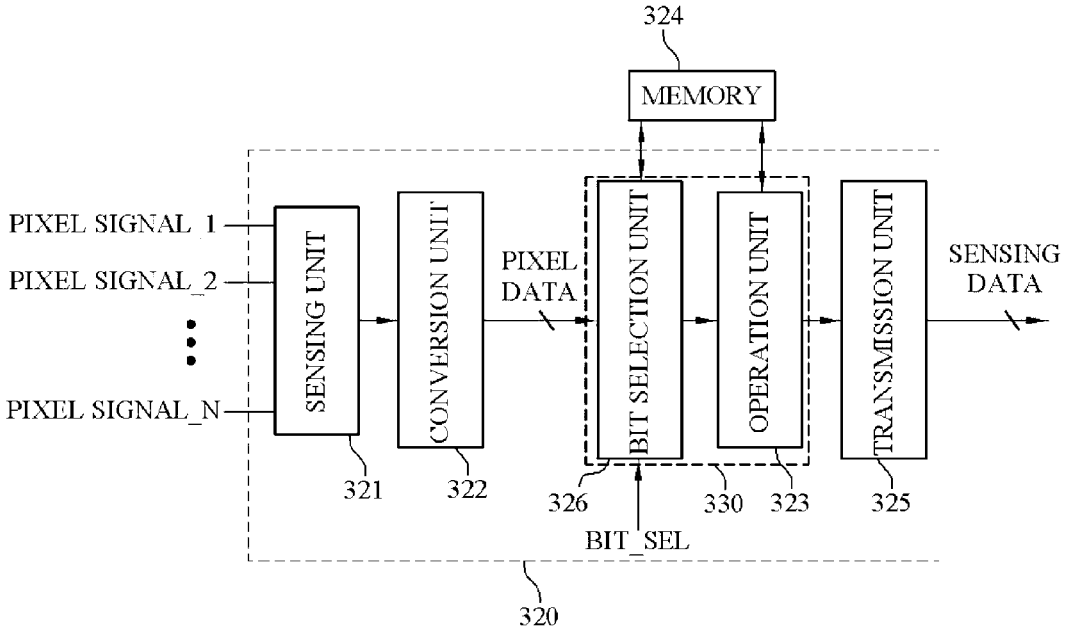
FIG. 5 is a block diagram illustrating yet another embodiment of the sensing circuit of FIG. 1.

Referring to FIG. 5, the sensing circuit 320 includes the sensing unit 321, the conversion unit 322, the operation circuit 330, the memory 324, and the transmission unit 325. The operation circuit 330 includes the bit selection unit 326 and the operation unit 323.

In FIG. 5, the bit selection unit 326 performs a first operation for selecting some of pixel data obtained by converting sensing signals of the pixels of the display panel, and the operation unit 323 generates sensing data by performing a second operation on the pixel data subjected to the first operation.

The elements included in the sensing circuit 320 of FIG. 5, which are the same as those of FIG. 2 and FIG. 3, will not be described in order to avoid redundancy.

In the embodiments of FIG. 4 and FIG. 5, when the sensing circuit 320 generates the sensing data by performing a pre-processing operation on the pixel data, it is possible to sequentially process an operation including at least one of an average and a difference and an operation for selecting a bit.

The memory 324 may be used for the operation of the bit selection unit 326 and the operation of the operation unit 323. To this end, the memory 324 may be configured to be shared by the operation unit 323 and the bit selection unit 326, or may be separately configured in the operation unit 323 and the bit selection unit 326.

Also in the embodiments of FIG. 4 and FIG. 5, the source driver 300 provides the timing controller 200 with the sensing data having a smaller number of bits than the pixel data by the pre-processing operation.

Therefore, the source driver 300 can reduce the operation burden of the timing controller 200. Furthermore, the source driver 300 can transmit a smaller amount of sensing data than the pixel data to the timing controller 200, thereby reducing the transmission time of the sensing data.

Furthermore, also in the embodiments of FIG. 4 and FIG. 5, the source driver 300 partially shares correction for the display data, so that it is possible to reduce a manufacturing cost and a mass production time of the timing controller 200.

What is claimed is:

1. A pixel sensing circuit of a source driver, comprising:

an operation circuit configured to generate sensing data having a smaller number of bits than pixel data, wherein the sensing data is generated by pre-processing the pixel data, the pixel data obtained by converting sensing signals of pixels of a display panel; and a transmission unit configured to receive the sensing data provided by the operation circuit and transmit the sensing data to a timing controller.

2. The pixel sensing circuit of the source driver of claim 1, further comprising:

a memory coupled to the operation circuit and configured to store data during the converting the sensing signals of the pixels of the display panel.

3. The pixel sensing circuit of the source driver of claim 1, wherein the operation circuit generates the sensing data by obtaining at least one of an average value of the pixel data and a difference between the pixel data.

4. The pixel sensing circuit of the source driver of claim 1, wherein the operation circuit generates the sensing data by selecting some of the pixel data.

5. The pixel sensing circuit of the source driver of claim 4, wherein the operation circuit generates the sensing data by selecting an upper bit or a lower bit of the pixel data.

6. The pixel sensing circuit of the source driver of claim 4, wherein the operation circuit generates the sensing data by selecting bits corresponding to a valid bit from bits of the pixel data.

7. The pixel sensing circuit of the source driver of claim 1, wherein the operation circuit comprises:

an operation unit that performs a first operation on the pixel data obtained by converting the sensing signals of the pixels of the display panel; and a bit selection unit that generates the sensing data by performing a second operation of selecting some of the pixel data subjected to the first operation.

8. The pixel sensing circuit of the source driver of claim 1, wherein the operation circuit comprises:

a bit selection unit that generates the sensing data by selecting some of the pixel data; and an operation unit that generates the sensing data having the smaller number of bits than the pixel data based on the selected some of the pixel data and provides the sensing data to the transmission unit.

9. The pixel sensing circuit of the source driver of claim 1, wherein the converting is performed by a conversion unit comprising at least an analog digital converter.

10. A pixel sensing circuit of a source driver, comprising:

a bit selection unit configured to receive a bit selection signal and based on the bit selection signal generate sensing data having a smaller number of bits than pixel data, wherein, the pixel data is obtained by converting sensing signals of pixels of a display panel; and a transmission unit configured to receive the sensing data provided by the bit selection unit and transmit the sensing data to a timing controller.

11. The pixel sensing circuit of the source driver of claim 10, further comprising:

a memory configured to during the converting the sensing signals of the pixels of the display panel.

12. The pixel sensing circuit of the source driver of claim 10, wherein the bit selection unit generates the sensing data by selecting an upper bit or a lower bit of the pixel data in correspondence to the bit selection signal.

13. The pixel sensing circuit of the source driver of claim 10, wherein the bit selection unit generates the sensing data by selecting bits corresponding to a valid bit from bits of the pixel data in correspondence to the bit selection signal.

14. A pixel sensing circuit of a source driver comprising:

an operation unit configured to receive pixel data obtained by converting sensing signals of pixels of a display panel and generate the sensing data having a smaller number of bits than the pixel data;

a bit selection unit, in response to receiving a bit selection signal and the sensing data, select some of the sensing data corresponding to the bit selection signal; and a data transmission unit configured to receive the sensing data and transmit the sensing data to a timing controller.

15. A pixel sensing circuit of a source driver comprising:

a bit selection unit, in response to receiving a bit selection signal and pixel data obtained by converting sensing signals obtained by pixels of a display panel, generating sensing data by selecting some of the pixel data corresponding to the bit selection signal;

an operation unit, in response to receiving the sensing data, generating a subset of the sensing data having a smaller number of bits than the sensing data; and a transmission unit configured to receive the sensing data and transmit the sensing data to a timing controller.

16. A display device comprising:

a source driver including a sensing circuit for receiving pixel data obtained by converting sensing signals of pixels of a display panel and pre-processing the pixel data to generate sensing data having a smaller number of bits than the pixel data; and a timing controller including a correction circuit for receiving the sensing data and configured to generate correction data for correction for characteristics of a pixel by post-processing the sensing data.

17. The display device of claim 16, wherein the sensing circuit comprises:

an operation unit configured to generate the sensing data by obtaining at least one of an average value of the pixel data and a difference between the pixel data.

18. The display device of claim 16, wherein the sensing circuit comprises:

a bit selection unit, in response to receiving a bit selection signal, generates the sensing data by selecting some of the pixel data by the bit selection signal.

19. The display device of claim 16, wherein the sensing circuit performs the pre-processing by including an operation unit that converts the sensing signals of the pixels of the display panel, and a bit selection unit that generates the sensing data by selecting some of the pixel.

20. The display device of claim 16, wherein the sensing circuit performs the pre-processing by including a bit selection unit that selects some of the pixel data obtained by converting the sensing signals of the pixels of the display panel, and an operation unit generates the sensing data based on the selection of some the pixel data.

* * * * *